US010111494B2

(12) United States Patent
Cross

(10) Patent No.: US 10,111,494 B2
(45) **Date of Patent: *Oct. 30, 2018**

(54) MIDSOLE COMPONENT AND OUTER SOLE MEMBERS WITH AUXETIC STRUCTURE

(71) Applicant: NIKE, Inc., Beaverton, OR (US)

(72) Inventor: Tory M. Cross, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 130 days.

This patent is subject to a terminal disclaimer.

(21) Appl. No.: 15/251,192

(22) Filed: Aug. 30, 2016

(65) Prior Publication Data

US 2016/0366976 A1 Dec. 22, 2016

Related U.S. Application Data

(63) Continuation of application No. 14/643,089, filed on Mar. 10, 2015, now Pat. No. 9,456,656, which is a continuation-in-part of application No. 14/030,002, filed on Sep. 18, 2013, now Pat. No. 9,402,439.

(51) Int. Cl.

| | |
|---|---|
| ***A43B 13/18*** | (2006.01) |
| ***A43B 13/22*** | (2006.01) |
| ***A43B 13/02*** | (2006.01) |
| ***A43B 1/00*** | (2006.01) |
| ***A43B 3/00*** | (2006.01) |
| ***A43B 5/00*** | (2006.01) |
| ***A43B 13/12*** | (2006.01) |
| ***A43B 13/14*** | (2006.01) |
| ***A43B 13/04*** | (2006.01) |

(52) U.S. Cl.

CPC ..... *A43B 13/186* (2013.01); *A43B 1/0009* (2013.01); *A43B 3/0073* (2013.01); *A43B 5/00* (2013.01); *A43B 13/02* (2013.01); *A43B 13/04* (2013.01); *A43B 13/122* (2013.01); *A43B 13/125* (2013.01); *A43B 13/14* (2013.01); *A43B 13/181* (2013.01); *A43B 13/187* (2013.01); *A43B 13/188* (2013.01); *A43B 13/223* (2013.01)

(58) Field of Classification Search

CPC ..... A43C 15/061; A43C 15/06; A43C 15/09; A43C 15/063; A43C 15/12; A43C 15/00; A43C 15/02; A43C 15/065; A43C 15/068; A43C 11/146; A43B 13/187; A43B 13/188; A43B 13/181; A43B 13/02; A43B 13/006; A43B 13/003; A43B 3/16

See application file for complete search history.

(56) References Cited

U.S. PATENT DOCUMENTS 2,800,423 A * 7/1957 De Swart ..... B29B 15/08 156/253
4,668,557 A * 5/1987 Lakes ..... B29C 44/357 264/321
5,188,874 A * 2/1993 Kauffman ..... B29B 15/08 156/163

(Continued)

*Primary Examiner* — Shaun R Hurley
*Assistant Examiner* — Bao-Thieu L Nguyen
(74) *Attorney, Agent, or Firm* — Quinn IP Law

(57) ABSTRACT

An article with a sole structure including a midsole component and an outer sole member are described. The sole structure includes a set of holes arranged in an auxetic configuration that permit the sole to expand in an auxetic manner. The set of holes extends through the midsole component and the outer sole member and both the midsole component and the outer sole member are exposed on an outer surface of the sole structure.

20 Claims, 9 Drawing Sheets

(56) References Cited

U.S. PATENT DOCUMENTS 7,434,338 B2 * 10/2008 Pfander ..... A43B 7/144 36/141
7,451,557 B2 * 11/2008 McDonald ..... A43B 1/0063 36/100
7,910,193 B2 * 3/2011 Ma ..... A47C 23/002 428/218
8,084,117 B2 * 12/2011 Lalvani ..... B32B 3/266 428/135
8,707,582 B2 * 4/2014 Klassen ..... A43B 13/181 267/161
8,844,170 B2 * 9/2014 Ferrigan ..... A43B 3/0042 36/102
9,044,067 B2 * 6/2015 Edington ..... A43B 7/144
9,402,439 B2 * 8/2016 Cross ..... A43B 13/22
9,456,656 B2 * 10/2016 Cross ..... A43B 13/181
9,474,326 B2 * 10/2016 Langvin ..... A43B 5/00
9,554,620 B2 * 1/2017 Cross ..... B32B 27/065
9,554,624 B2 * 1/2017 Cross ..... A43B 13/22
9,681,703 B2 * 6/2017 Cross ..... A43B 13/223
2007/0213838 A1 * 9/2007 Hengelmolen ..... A61F 2/91 623/23.71
2008/0248710 A1 * 10/2008 Wittner ..... D04H 1/492 442/328
2010/0095551 A1 * 4/2010 Gupta ..... A43B 7/144 36/29
2010/0107448 A1 * 5/2010 Fallow ..... A43B 3/0042 36/103
2010/0293815 A1 * 11/2010 Ferrigan ..... A43B 3/0042 36/25 R
2011/0059291 A1 * 3/2011 Boyce ..... C08J 5/00 428/136
2011/0144417 A1 * 6/2011 Jagger ..... A61F 2/0045 600/30
2011/0168313 A1 * 7/2011 Ma ..... B60O 7/14 152/302
2011/0282452 A1 * 11/2011 Koerner ..... A61L 27/50 623/16.11
2015/0007456 A1 * 1/2015 Klassen ..... A43B 13/181 36/102
2015/0251493 A1 * 9/2015 Ma ..... B60O 7/14 152/80
2016/0095385 A1 * 4/2016 Nordstrom ..... A43B 13/181 36/29
2017/0238652 A1 * 8/2017 Langvin ..... A43B 13/04

* cited by examiner

MIDSOLE COMPONENT AND OUTER SOLE MEMBERS WITH AUXETIC STRUCTURE

CROSS-REFERENCE TO RELATED APPLICATIONS

This application is a continuation of U.S. patent application Ser. No. 14/643,089, filed Mar. 10, 2015, and entitled "Midsole Component and Outer Sole Members With Auxetic Structure", which application is a continuation-in-part of U.S. patent application Ser. No. 14/030,002, filed Sep. 18, 2013, and titled "Auxetic Structures and Footwear with Soles Having Auxetic Structures," the entirety of which is herein incorporated by reference. This application is related to co-pending U.S. patent application Ser. No. 14/643,121, filed Mar. 10, 2015, titled "Sole Structure with Holes Arranged in Auxetic Configuration", the entirety of which is herein incorporated by reference. This application is also related to co-pending U.S. patent application Ser. No. 14/643,161, filed Mar. 10, 2015, titled "Multi-Component Sole Structure Having an Auxetic Configuration", the entirety of which is herein incorporated by reference.

BACKGROUND

The present embodiments relate generally to articles of footwear, and in particular to articles of footwear with uppers and sole structures.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

SUMMARY

In one aspect, an article of footwear includes a sole structure including a midsole component and at least one outer sole member. The midsole component includes a first outer surface with a recessed portion. The outer sole member has a second outer surface. The recessed portion is configured to receive the outer sole member. A region of the sole structure includes a first portion in the first outer surface of the midsole component and a second portion in the second outer surface of the outer sole member. The region includes a set of holes arranged in an auxetic configuration. The auxetic configuration extends without interruption from the first portion into the second portion.

In another aspect, an article of footwear includes a sole structure including a midsole component and at least one outer sole member. The midsole component includes a first outer surface with a recessed portion. The outer sole member has a second outer surface. The recessed portion is configured to receive the outer sole member. A region of the sole structure includes a first portion in the first outer surface and a second portion in the second outer surface. The region including a set of holes arranged in an auxetic configuration. At least one hole of the set of holes is disposed in the first outer surface and at least one hole of the set of holes is disposed in the second outer surface. The first outer surface has a first coefficient of friction relative to a predetermined material, wherein the second outer surface has a second coefficient of friction relative to the predetermined material, and the second coefficient of friction is greater than the first coefficient of friction.

In another aspect, an article of footwear includes a sole structure including a midsole component. The midsole component includes a plurality of openings arranged in an auxetic configuration. The plurality of openings include a first opening surrounded by a first sole portion, a second sole portion, a third sole portion, a fourth sole portion, a fifth sole portion and a sixth sole portion. The first sole portion includes a first raised tread element, the second sole portion includes a second raised tread element, the third sole portion includes a third raised tread element, the fourth sole portion includes a fourth raised tread element, the fifth sole portion includes a fifth raised tread element and the sixth sole portion includes a sixth raised tread element.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
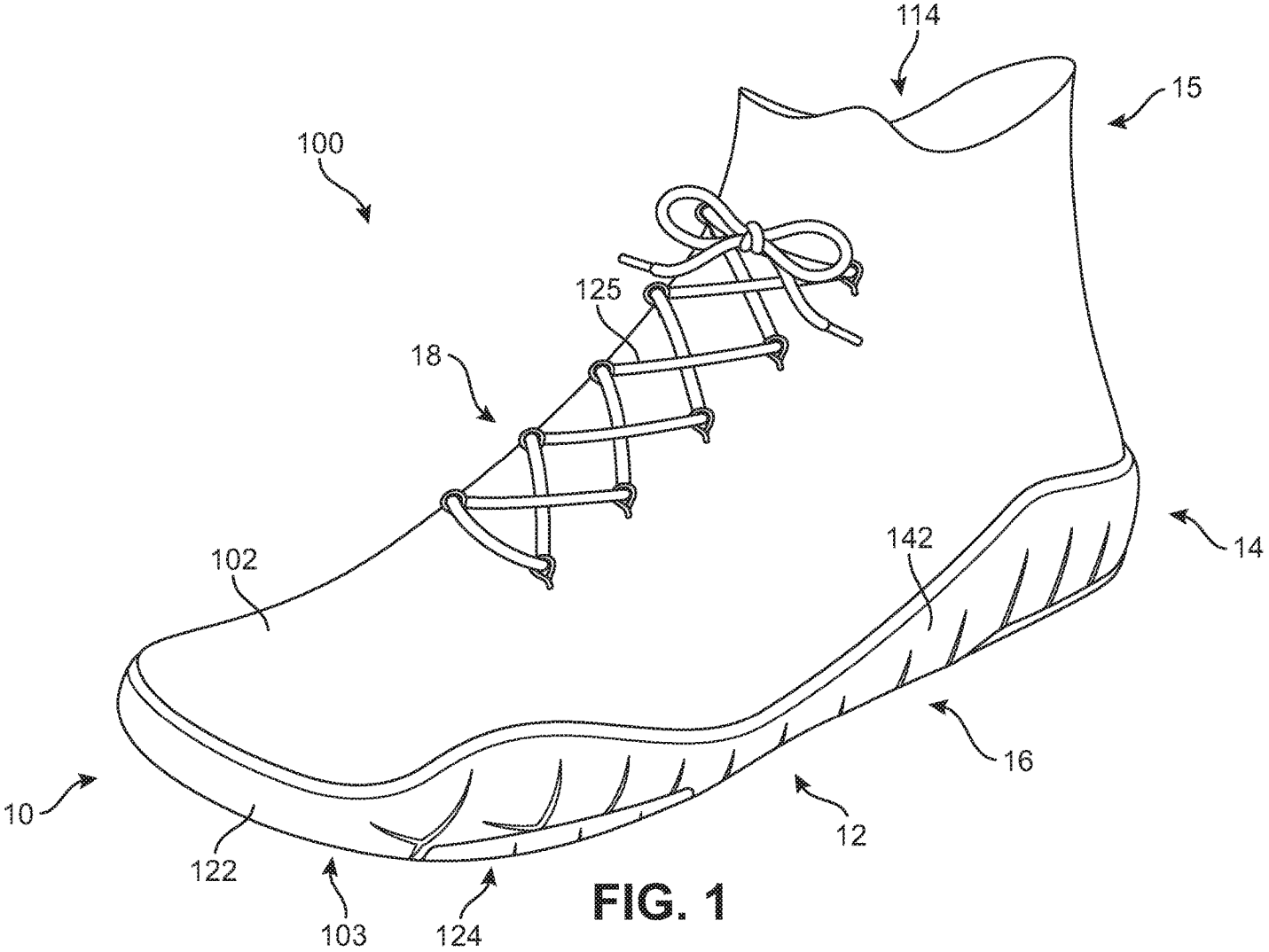
FIG. 1 is an isometric view of an embodiment of an article of footwear.

FIG. 1 is an isometric view of an embodiment of an article of footwear 100. In the exemplary embodiment, article of footwear 100 has the form of an athletic shoe. However, in other embodiments, the provisions discussed herein for article of footwear 100 could be incorporated into various other kinds of footwear including, but not limited to: basketball shoes, hiking boots, soccer shoes, football shoes, sneakers, running shoes, cross-training shoes, rugby shoes, baseball shoes as well as other kinds of shoes. Moreover, in some embodiments, the provisions discussed herein for article of footwear 100 could be incorporated into various other kinds of non-sports related footwear, including, but not limited to: slippers, sandals, high heeled footwear, and loafers.

For purposes of clarity, the following detailed description discusses the features of article of footwear 100, also referred to simply as article 100. However, it will be understood that other embodiments may incorporate a corresponding article of footwear (e.g., a right article of footwear when article 100 is a left article of footwear) that may share some, and possibly all, of the features of article 100 described herein and shown in the figures.

The embodiments may be characterized by various directional adjectives and reference portions. These directions and reference portions may facilitate in describing the portions of an article of footwear. Moreover, these directions and reference portions may also be used in describing sub-components of an article of footwear (e.g., directions and/or portions of an inner sole component, a midsole component, an outer sole component, an upper or any other components).

For consistency and convenience, directional adjectives are employed throughout this detailed description corresponding to the illustrated embodiments. The term "longitudinal" as used throughout this detailed description and in the claims refers to a direction extending a length of a component (e.g., an upper or sole component). In some cases, the longitudinal direction may extend from a forefoot portion to a heel portion of the component. Also, the term "lateral" as used throughout this detailed description and in the claims refers to a direction extending along a width of a component. In other words, the lateral direction may extend between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. Additionally, the term "inner" refers to a portion of an article disposed closer to an interior of an article, or closer to a foot when the article is worn. Likewise, the term "outer" refers to a portion of an article disposed further from the interior of the article or from the foot. Thus, for example, the inner surface of a component is disposed closer to an interior of the article than the outer surface of the component. This detailed description makes use of these directional adjectives in describing an article and various components of the article, including an upper, a midsole structure and/or an outer sole structure.

Article 100 may be characterized by a number of different regions or portions. For example, article 100 could include a forefoot portion, a midfoot portion, a heel portion and an ankle portion. Moreover, components of article 100 could likewise comprise corresponding portions. Referring to FIG. 1, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. Article 100 may also include an ankle portion 15 (which may also be referred to as a cuff portion). In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12, heel portion 14 and ankle portion 15.

Figure 2:
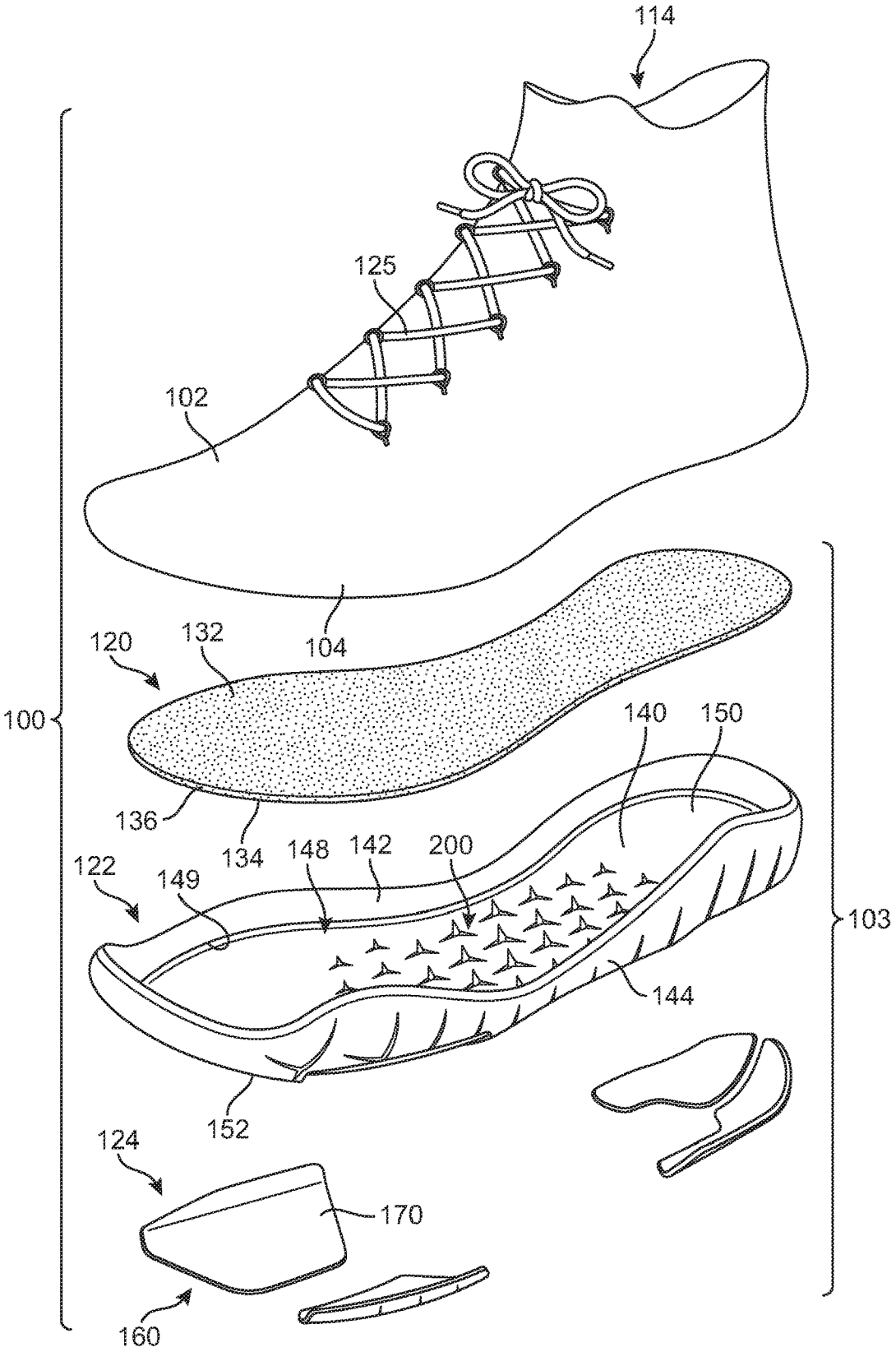
FIG. 2 is an exploded isometric view of an embodiment of an article of footwear, including a sole structure comprised of an inner sole component, a midsole component and a plurality of outer sole members.

FIG. 2 illustrates an exploded isometric view of an embodiment of article of footwear 100. FIGS. 1-2 illustrate various components of article of footwear 100, including an upper 102 and a sole structure 103.

Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

In some embodiments, upper 102 includes opening 114 that provides entry for the foot into an interior cavity of upper 102. In some embodiments, upper 102 may also include a tongue (not shown) that provides cushioning and support across the instep of the foot. Some embodiments may include fastening provisions, including, but not limited to: laces, cables, straps, buttons, zippers as well as any other provisions known in the art for fastening articles. In some embodiments, a lace 125 may be applied at a fastening region of upper 102.

Some embodiments may include uppers that extend beneath the foot, thereby providing 360 degree coverage at some regions of the foot. However, other embodiments need not include uppers that extend beneath the foot. In other embodiments, for example, an upper could have a lower periphery joined with a sole structure and/or sock liner.

An upper could be formed from a variety of different manufacturing techniques resulting in various kinds of upper structures. For example, in some embodiments, an upper could have a braided construction, a knitted (e.g., warp-knitted) construction or some other woven construction. In an exemplary embodiment, upper 102 may be a knitted upper.

In some embodiments, sole structure 103 may be configured to provide traction for article 100. In addition to providing traction, sole structure 103 may attenuate ground reaction forces when compressed between the foot and the ground during walking, running or other ambulatory activities. The configuration of sole structure 103 may vary significantly in different embodiments to include a variety of conventional or non-conventional structures. In some cases, the configuration of sole structure 103 can be configured according to one or more types of ground surfaces on which sole structure 103 may be used. Examples of ground surfaces include, but are not limited to: natural turf, synthetic turf, dirt, hardwood flooring, as well as other surfaces.

Sole structure 103 is secured to upper 102 and extends between the foot and the ground when article 100 is worn. In different embodiments, sole structure 103 may include different components. In the exemplary embodiment shown in FIGS. 1-2, sole structure 103 may include inner sole component 120, midsole component 122 and a plurality of outer sole members 124. In some cases, one or more of these components may be optional.

Referring now to FIG. 2, in some embodiments, inner sole component 120 may be configured as an inner layer for a midsole. For example, as discussed in further detail below, inner sole component 120 may be integrated, or received, into a portion of midsole component 122. However, in other embodiments, inner sole component 120 could function as an insole layer and/or as a strobel layer. Thus, in at least some embodiments, inner sole component 120 could be joined (e.g., stitched or glued) to lower portion 104 of upper 102 for purposes of securing sole structure 103 to upper 102.

Inner sole component 120 may have an inner surface 132 and an outer surface 134. Inner surface 132 may generally be oriented towards upper 102. Outer surface 134 may be generally oriented towards midsole component 122. Furthermore, a peripheral sidewall surface 136 may extend between inner surface 132 and outer surface 134.

Midsole component 122 may be configured to provide cushioning, shock absorption, energy return, support, as well as possibly other provisions. To this end, midsole component 122 may have a geometry that provides structure and support for article 100. Specifically, midsole component 122 may be seen to have a lower portion 140 and a sidewall portion 142. Sidewall portion 142 may extend around the entire periphery 144 of midsole component 122. As seen in FIG. 1, sidewall portion 142 may partially wrap up the sides of article 100 to provide increased support along the base of the foot.

Midsole component 122 may further include an inner surface 150 and an outer surface 152. Inner surface 150 may be generally oriented towards upper 102, while outer surface 152 may be oriented outwardly. Furthermore, in the exemplary embodiment, midsole component 122 includes a central recess 148 disposed in inner surface 150. Central recess 148 may generally be sized and configured to receive inner sole component 120.

In some embodiments, midsole component 122 may include a plurality of holes 200, at least some of which may extend through the entire thickness of midsole component 122. In the exemplary embodiment shown in FIG. 2, some of the plurality of holes 200 are visible within central recess 148.

In different embodiments, midsole component 122 may generally incorporate various provisions associated with midsoles. For example, in one embodiment, a midsole component may be formed from a polymer foam material that attenuates ground reaction forces (i.e., provides cushioning) during walking, running, and other ambulatory activities. In various embodiments, midsole components may also include fluid-filled chambers, plates, moderators, or other elements that further attenuate forces, enhance stability, or influence the motions of the foot, for example.

Figure 3:
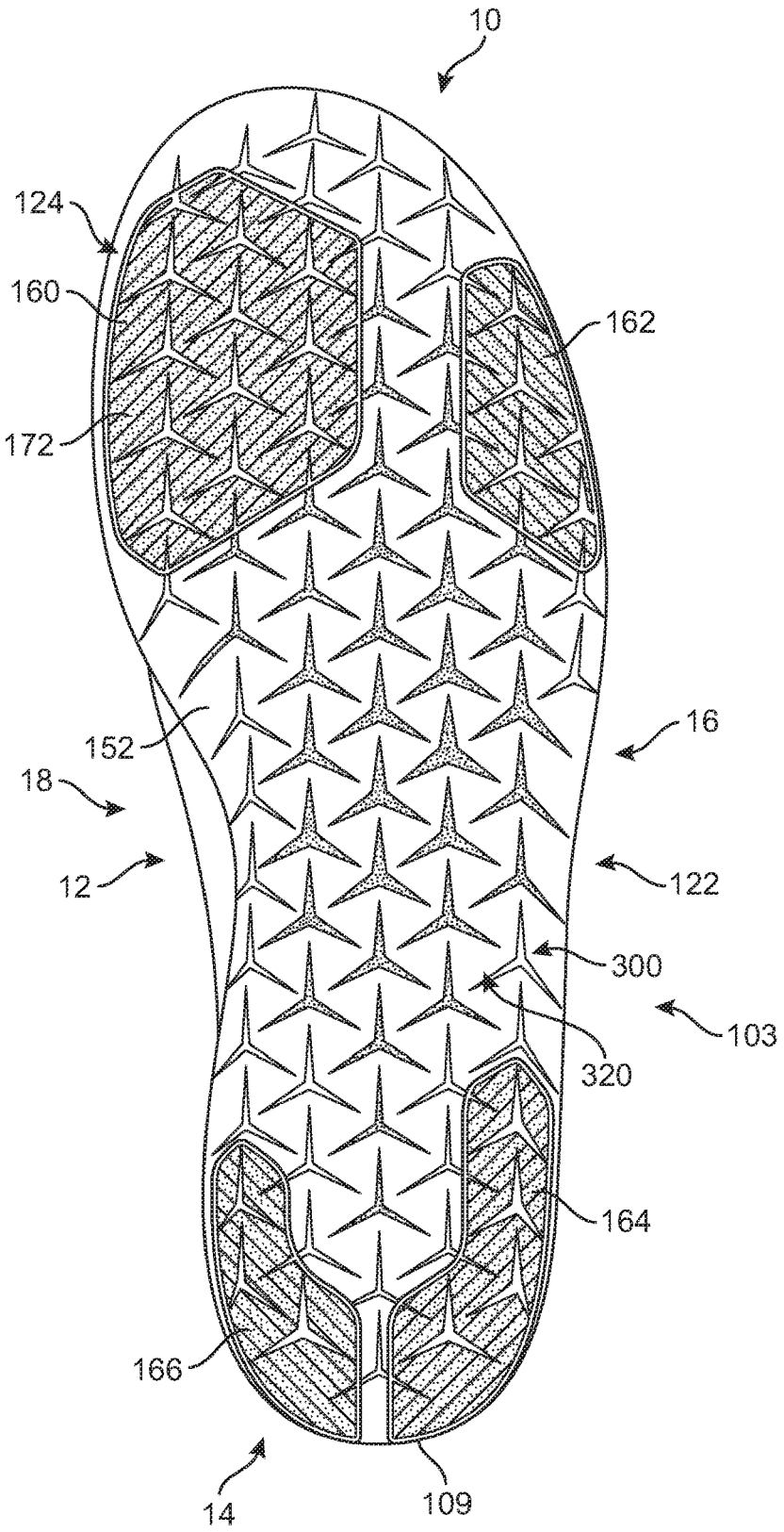
FIG. 3 is a bottom view of an embodiment of an article of footwear.

FIG. 3 illustrates a bottom view of sole structure 103. As seen in FIGS. 2-3, plurality of outer sole members 124 comprises four distinct outer sole members. Specifically, sole structure 103 includes a first outer sole member 160, a second outer sole member 162, a third outer sole member 164 and a fourth outer sole member 166. Although the exemplary embodiment includes four different outer sole members, other embodiments could include any other number of outer sole members. In another embodiment, for example, only a single outer sole member may be present. In still another embodiment, only two outer sole members may be used. In still another embodiment, only three outer sole members could be used. In still other embodiments, five or more outer sole members could be used.

Generally, an outer sole member may be configured as a ground contacting member. In some embodiments, an outer sole member could include properties associated with outsoles, such as durability, wear-resistance and increased traction. In other embodiments, an outer sole member could include properties associated with a midsole, including cushioning, strength and support. In the exemplary embodiment, plurality of outer sole members 124 may be configured as outsole-like members that enhance traction with a ground surface while maintaining wear resistance.

In different embodiments, the locations of one or more outer sole members could vary. In some embodiments, one or more outer sole members could be disposed in a forefoot portion of a sole structure. In other embodiments, one or more outer sole members could be disposed in a midfoot portion of a sole structure. In still other embodiments, one or more outer sole members could be disposed in a heel portion of a sole structure. In an exemplary embodiment, first outer sole member 160 and second outer sole member 162 may be disposed in forefoot portion 10 of sole structure 103. More specifically, first outer sole member 160 may be disposed on medial side 18 of forefoot portion 10, while second outer sole member 162 may be disposed on lateral side 16 of forefoot portion 10. In addition, in the exemplary embodiment third outer sole member 164 and fourth outer sole member 166 may be disposed in heel portion 14 of sole structure 103. More specifically, third outer sole member 164 may be disposed on lateral side 16 and fourth outer sole member 166 may be disposed on medial side 18. Furthermore, it can be seen that first outer sole member 160 and second outer sole member 162 are spaced apart from one another in the center of forefoot portion 10, while third outer sole member 164 and fourth outer sole member 166 are spaced apart from one another in the center of heel portion 14. This exemplary configuration provides outer sole members at areas of increased ground contact during various lateral and medial cuts, so as to enhance traction during these motions.

The sizes of various outer sole members could vary. In the exemplary embodiment, first outer sole member 160 may be the largest outer sole member of plurality of outer sole members 124. Moreover, second outer sole member 162 may be substantially smaller than first outer sole member 160 thereby enhancing traction more on a medial side 18 of sole structure 103 than on lateral side 16 in forefoot portion 10. At heel portion 14, third outer sole member 164 and fourth outer sole member 166 are both widest along a rearward edge 109 of sole structure 103, and taper slightly towards midfoot portion 12.

Referring to FIGS. 2 and 3, first outer sole member 160 may be seen to have an inner surface 170 and an outer surface 172. Inner surface 170 may generally be disposed against midsole component 122. Outer surface 172 may face outwardly and may be a ground contacting surface. For purposes of clarity, only the inner and outer surfaces of first outer sole member 160 are indicated in FIGS. 2-3, however it will be understood that the remaining outer sole members may likewise include corresponding inner and outer surfaces that have similar orientations with respect to midsole component 122.

In the exemplary embodiment, inner sole component 120 may be disposed within central recess 148 of midsole component 122. More specifically, outer surface 134 of inner sole component 120 may be oriented towards, and be in contact with, inner surface 150 of midsole component 122. Furthermore, in some cases, peripheral sidewall surface 136 may also contact inner surface 150 along an inner recess sidewall 149. In addition, plurality of outer sole members 124 may be disposed against outer surface 152 of midsole component 122. For example, inner surface 170 of first outer sole member 160 may face towards, and be in contact with, outer surface 152 of midsole component 122. In some embodiments, when assembled, midsole component 122 and inner sole component 120 could comprise a composite midsole assembly, or dual layered midsole assembly.

In different embodiments, upper 102 and sole structure 103 could be joined in various ways. In some embodiments, upper 102 could be joined to inner sole component 120, e.g., using an adhesive or by stitching. In other embodiments, upper 102 could be joined to midsole component 122, for example, along sidewall portion 142. In still other embodiments, upper 102 could be joined with both inner sole component 120 and midsole component 122. Moreover, these components may be joined using any methods known in the art for joining sole components with uppers, including various lasting techniques and provisions (e.g., board lasting, slip lasting, etc.).

In different embodiments, the attachment configurations of various components of article 100 could vary. For example, in some embodiments, inner sole component 120 could be bonded or otherwise attached to midsole component 122. Such bonding or attachment could be accomplished using any known methods for bonding components of articles of footwear, including, but not limited to: adhesives, films, tapes, staples, stitching, or other methods. In some other embodiments, it is contemplated that inner sole component 120 may not be bonded or attached to midsole component 122, and instead could be free-floating. In at least some embodiments, inner sole component 120 may have a friction fit with central recess 148 of midsole component 122.

Outer sole members 124 may be likewise be bonded or otherwise attached to midsole component 122. Such bonding or attachment could be accomplished using any known methods for bonding components of articles of footwear, including, but not limited to: adhesives, films, tapes, staples, stitching, or other methods.

It is contemplated that in at least some embodiments, two or more of inner sole component 120, midsole component 122 and/or outer sole members 124 could be formed and/or bonded together during a molding process. For example, in some embodiments, upon forming midsole component 122, inner sole member 120 could be molded within central recess 148.

Embodiments can include provisions to facilitate expansion and/or adaptability of a sole structure during dynamic motions. In some embodiments, a sole structure may be configured with auxetic provisions. In particular, one or more components of the sole structure may be capable of undergoing auxetic motions (e.g., expansion and/or contraction).

Sole structure 103 as shown in FIGS. 1-5 and as described further in detail below, has an auxetic structure or configuration. Sole structures comprising auxetic structures are described in Cross, U.S. patent application Ser. No. 14/030,002, filed Sep. 18, 2013 and entitled "Auxetic Structures and Footwear with Soles Having Auxetic Structures" (the "Auxetic Structures application"), the entirety of which is hereby incorporated by reference.

Figure 4:
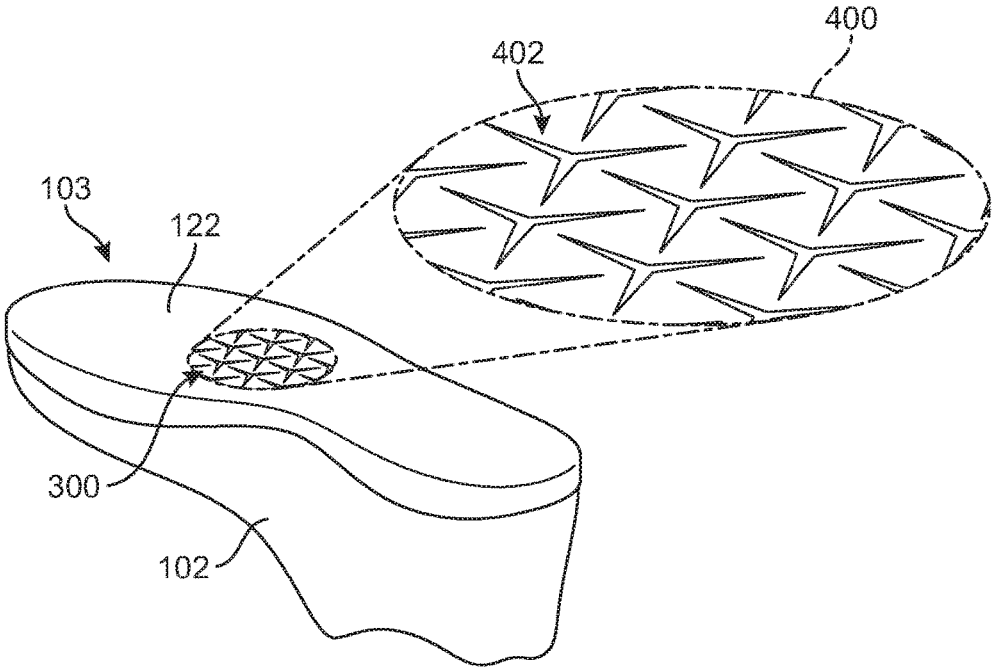
FIG. 4 is a bottom isometric view of an embodiment of a sole structure including an enlarged schematic view of a portion of the sole structure.
Figure 5:
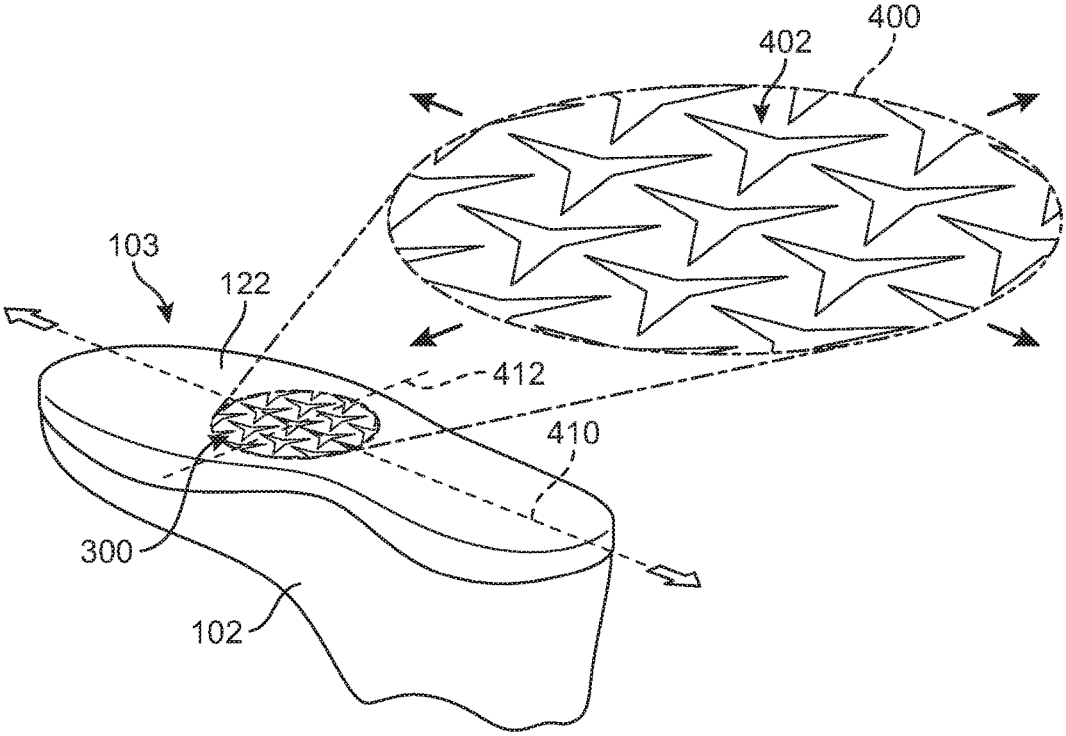
FIG. 5 is a bottom isometric view of an embodiment of a sole structure including an enlarged schematic view of a portion of the sole structure, in which the portion of the sole structure is undergoing auxetic expansion.

As described in the Auxetic Structures application, auxetic materials have a negative Poisson's ratio, such that when they are under tension in a first direction, their dimensions increase both in the first direction and in a second direction orthogonal or perpendicular to the first direction. This property of an auxetic material is illustrated in FIGS. 4 and 5.

As seen in FIG. 3, sole structure 103 may include a plurality of holes 300. As used herein, the term "hole" refers to any hollowed area or recessed area in a component. In some cases, a hole may be a through hole, in which the hole extends between two opposing surfaces of a component. In other cases, a hole may be a blind-hole, in which the hole may not extend through the entire thickness of the component and may therefore only be open on one side. Moreover, as discussed in further detail below, a component may utilize a combination of through holes and blind-holes. Furthermore, the term "hole" may be used interchangeably in some cases with "aperture" or "recess".

In regions including one or more holes, sole structure 103 may be further associate with a plurality of discrete sole portions 320. Specifically, sole portions 320 comprise the portions of sole structure 103 that extend between plurality of holes 300. It may also be seen that plurality of holes 300 extend between sole portions 320. Thus it may be understood that each hole may be surrounded by a plurality of sole portions, such that the boundary of each hole may be defined by the edges of the sole portions. This arrangement between holes (or apertures) and sole portions, is discussed in further detail in the Auxetic Structures application.

As seen in FIG. 3, plurality of holes 300 may extend through a majority of midsole component 122. In some embodiments, plurality of holes 300 may extend through forefoot portion 10, midfoot portion 12 and heel portion 14 of midsole component 122. In other embodiments, plurality of holes 300 may not extend through each of these portions.

Plurality of holes 300 may also extend through plurality of outer sole members 124. In the exemplary embodiment, each of first outer sole member 160, second outer sole member 162, third outer sole member 164 and fourth outer sole member 166 includes two or more holes. However, in other embodiments, one or more outer sole members may not include any holes.

In different embodiments, the geometry of one or more holes could vary. Examples of different geometries that could be used for an auxetic sole structure are disclosed in the Auxetic Structures application. Moreover, embodiments could also utilize any other geometries, such as utilizing sole portions with parallelogram geometries or other polygonal geometries that are arranged in a pattern to provide the sole with an auxetic structure. In the exemplary embodiment, each hole of plurality of holes 300 has a tri-star geometry, including three arms or points extending from a common center.

The geometry of one or more sole portions could also vary. Examples of different geometries that could be used for an auxetic sole structure are disclosed in the Auxetic Structures application. It may be understood that the geometry of a sole portion may be determined by the geometry of the holes in an auxetic pattern, and vice versa. In the exemplary embodiment, each sole portion has an approximately triangular geometry.

Plurality of holes 300 may be arranged on sole structure 103 in an auxetic pattern, or auxetic configuration. In other words, plurality of holes 300 may be arranged on midsole component 122 and/or outer sole members 124 in a manner that allows those components to undergo auxetic motions, such as expansion or contraction. An example of auxetic expansion, which occurs as the result of the auxetic configuration of plurality of holes 300, is shown in FIGS. 4 and 5. Initially, in FIG. 4, sole structure 103 is in a non-tensioned state. In this state, plurality of holes 300 have an untensioned area. For purposes of illustration, only a region 400 of midsole component 122 is shown, where region 400 includes a subset of holes 402.

As tension is applied across sole structure 103 along an exemplary linear direction 410 (e.g., a longitudinal direction), as shown in FIG. 5, sole structure 103 undergoes auxetic expansion. That is, sole structure 103 expands along direction 410, as well as in a second direction 412 that is perpendicular to direction 410. In FIG. 5, the representative region 400 is seen to expand in both direction 410 and direction 412 simultaneously, as holes 402 increase in size.

Figure 6:
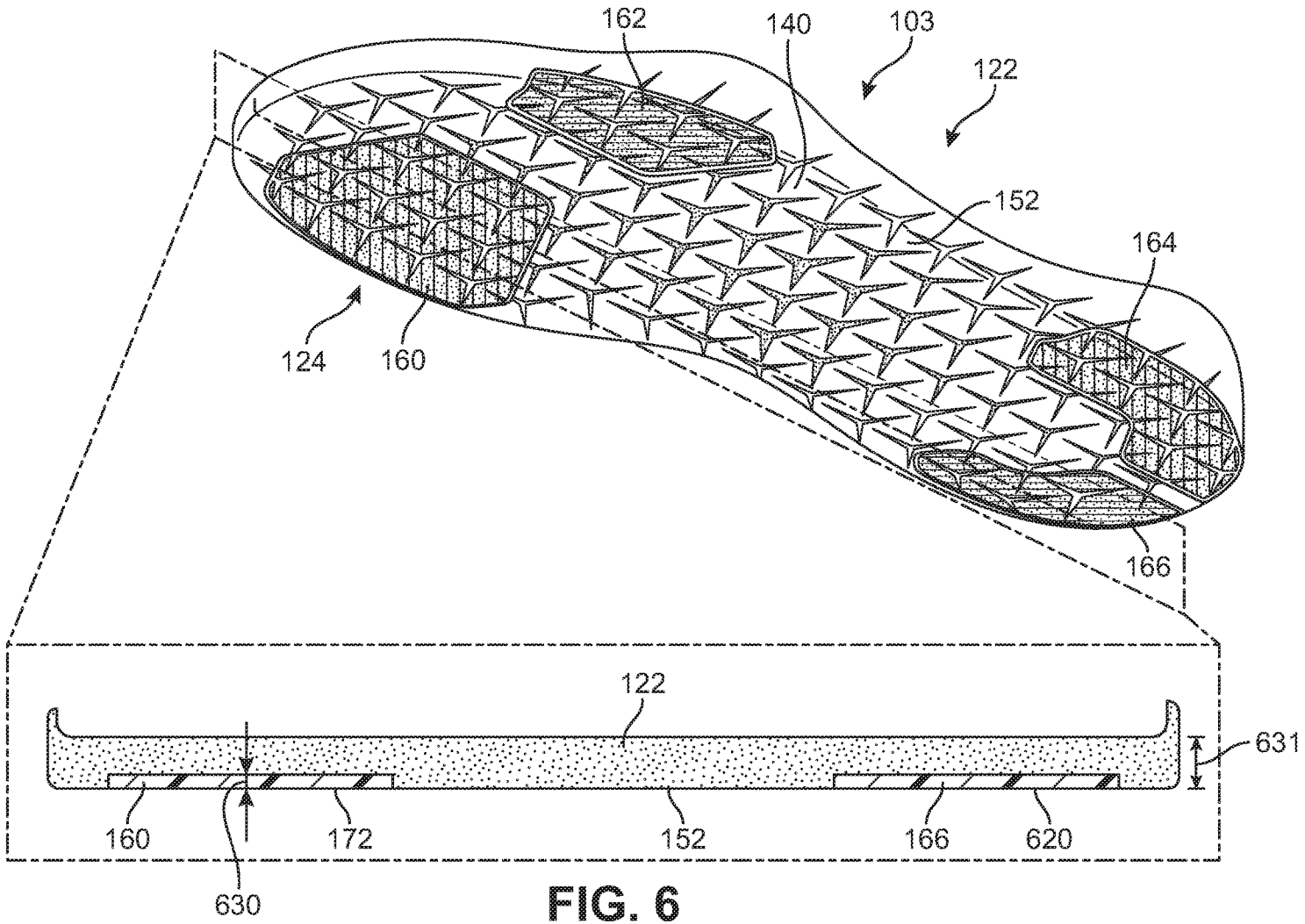
FIG. 6 is a bottom isometric view of an embodiment of a sole structure including an enlarged longitudinal cross-sectional view of the sole structure.
Figure 7:
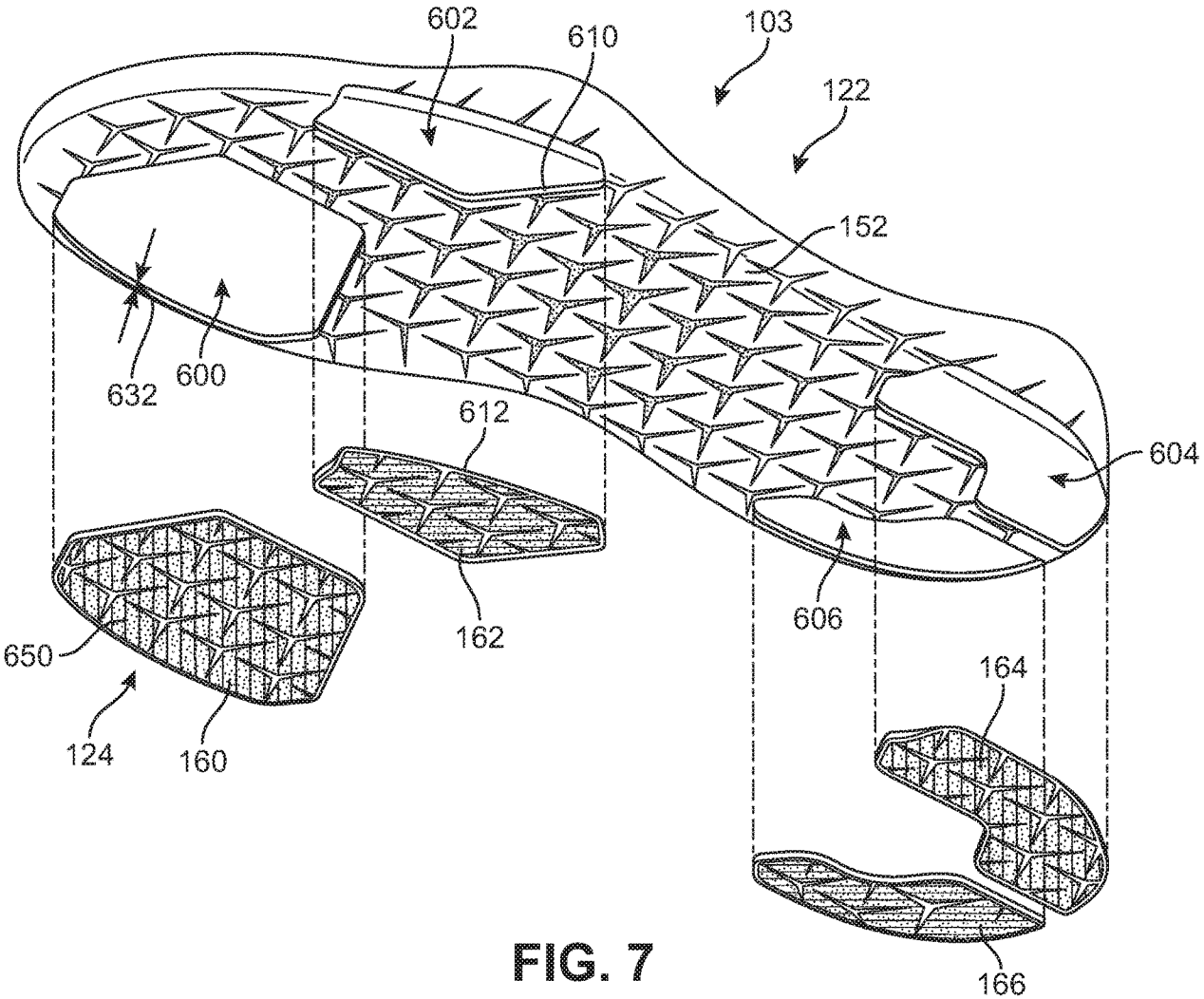
FIG. 7 is an exploded bottom isometric view of an embodiment of a sole structure including a plurality of outer sole members.

FIG. 6 illustrates a bottom isometric view of sole structure 103, including an enlarged cross-sectional view of midsole component 122 and two outer sole members. FIG. 7 illustrates an exploded bottom isometric view of an embodiment of midsole component 122 and outer sole members 124. Referring to FIGS. 6-7, each outer sole member may be associated with a corresponding recessed portion in outer surface 152 of midsole component 122. Specifically, midsole component 122 includes first recessed portion 600 for receiving first outer sole member 160; second recessed portion 602 for receiving second outer sole member 162; third recessed portion 604 for receiving third outer sole member 164 and fourth recessed portion 606 for receiving fourth outer sole member 166. Each recessed portion may be sized and shaped to fit a corresponding outer sole member. Thus, for example, second recessed portion 602 has an outer recess edge 610 that has the same shape as outer edge 612 of second outer sole member 162.

In some embodiments, an outer sole member could be flush with an outer surface of a midsole component. In the exemplary embodiment, each of outer sole members 124 may be flush with midsole component 122. For example, as seen in FIG. 6, outer surface 172 of first outer sole member 160 may be flush with outer surface 152 of midsole component 122. Likewise, an outer surface 620 of fourth outer sole member 166 may be flush with outer surface 152. In a similar manner, both second outer sole member 162 and third outer sole member 164 may be flush with midsole component 122. This flush configuration may be achieved by having the thickness of each outer sole member approximately equal to the depth of the receiving recessed portion. For example, as shown in FIG. 6, first outer sole member 160 is seen to have a thickness 630 that is approximately equal to a depth 632 of first recessed portion 600 (see FIG. 7). In other embodiments, one or more outer sole members could extend outwardly from a recessed portion. In still other embodiments, the outer surface of an outer sole member could be recessed with respect to outer surface 152 of midsole component 122.

As shown in FIG. 6, midsole component 122 may generally be thicker than each outer sole member. For example, midsole component 122 has a thickness 631 associated with a thickness of lower portion 140 of midsole component 122. In this exemplary embodiment, thickness 631 is greater than thickness 630, so that each outer sole member extends into a recess of, but does not extend through the entire thickness of, midsole component 122. This arrangement ensures midsole component 122 can provide cushioning and support in portions of sole structure 103 associated with outer sole members.

In different embodiments, the materials and/or physical properties of an outer sole member could vary. In some embodiments, an outer sole member could have a relatively high coefficient of friction when compared to a midsole component. For example, in an exemplary embodiment, first outer sole member 160 may have a first coefficient of friction with a predetermined material (e.g., wood, laminate, asphalt, concrete, etc.) and midsole component 122 may have a second coefficient of friction with the same predetermined material. In some embodiments, the first coefficient of friction is different than the second coefficient of friction. In an exemplary embodiment, the first coefficient of friction is greater than the second coefficient of friction, so that first outer sole member 160 provides increased traction (or grip) with the predetermined material than midsole component 122. In at least some embodiments, the predetermined material may be associated with a type of ground surface. For example, the predetermined material could be wood associated with wood flooring in basketball courts. In other embodiments, the predetermined material could be laminate materials that may also be associated with some kinds of courts. In still other embodiments, the predetermined material could be asphalt. In still other embodiments, the predetermined material could be concrete.

Likewise, in some embodiments, each of the remaining outer sole members may also have higher coefficients of friction (relative to a given ground surface) than midsole component 122. This arrangement may allow a user to brake or make cuts by engaging at least one of the outer sole members with a ground surface. It will be understood that in other embodiments, first outer sole member 160 could have a coefficient of friction equal to or less than the coefficient of friction of midsole component 122.

It may be appreciated that the coefficient of friction may change according to ambient conditions such as temperature, velocity, etc. Moreover, the coefficients of friction could be different for dry vs. wet conditions. As used herein, the first coefficient of friction and the second coefficient of friction defined for first outer sole member 160 and midsole component 122, respectively, may be dry coefficients of friction at standard temperatures and pressures.

Increased friction with a ground surface can be achieved by utilizing materials having higher coefficients of friction and/or by providing surface features that enhance grip with the ground. Such features could include tread elements such as ridges, hemispheric protrusions, cylindrical protrusions as well as other kinds of tread elements. In the exemplary embodiment, first outer sole member 160 is provided with a plurality of ridge elements 650, which may be best seen in FIGS. 8-9. In contrast, outer surface 152 of midsole component 122 may be seen to have a relatively smooth surface.

In different embodiments, the densities of an outer sole member and/or a midsole component could vary. In some embodiments, an outer sole member may have a higher density than a midsole component, thereby allowing for increased durability and wear resistance for the outer sole member. In other embodiments, however, the density of the outer sole member could be equal to the density of the midsole component, or could be less than the density of the midsole component.

Outer sole members could be manufactured from a variety of different materials. Exemplary materials include, but are not limited to: rubber (e.g., carbon rubber or blown rubber), polymers, thermoplastics (e.g., thermoplastic polyurethane), as well as possibly other materials. In contrast, midsole components may generally be manufactured from polyurethane, polyurethane foam, other kinds of foams as well as possibly other materials. It will be understood that the type of materials for outer sole members and a midsole component could be selected according to various factors including manufacturing requirements and desired performance characteristics. In an exemplary embodiment, suitable materials for outer sole members 124 and midsole component 122 could be selected to ensure outer sole members 124 have a larger coefficient of friction that midsole component 122, especially when these components are in contact with hardwood surfaces, laminate surfaces, asphalt, as well as other surfaces where article of footwear 100 may be most commonly used.

Figure 8:
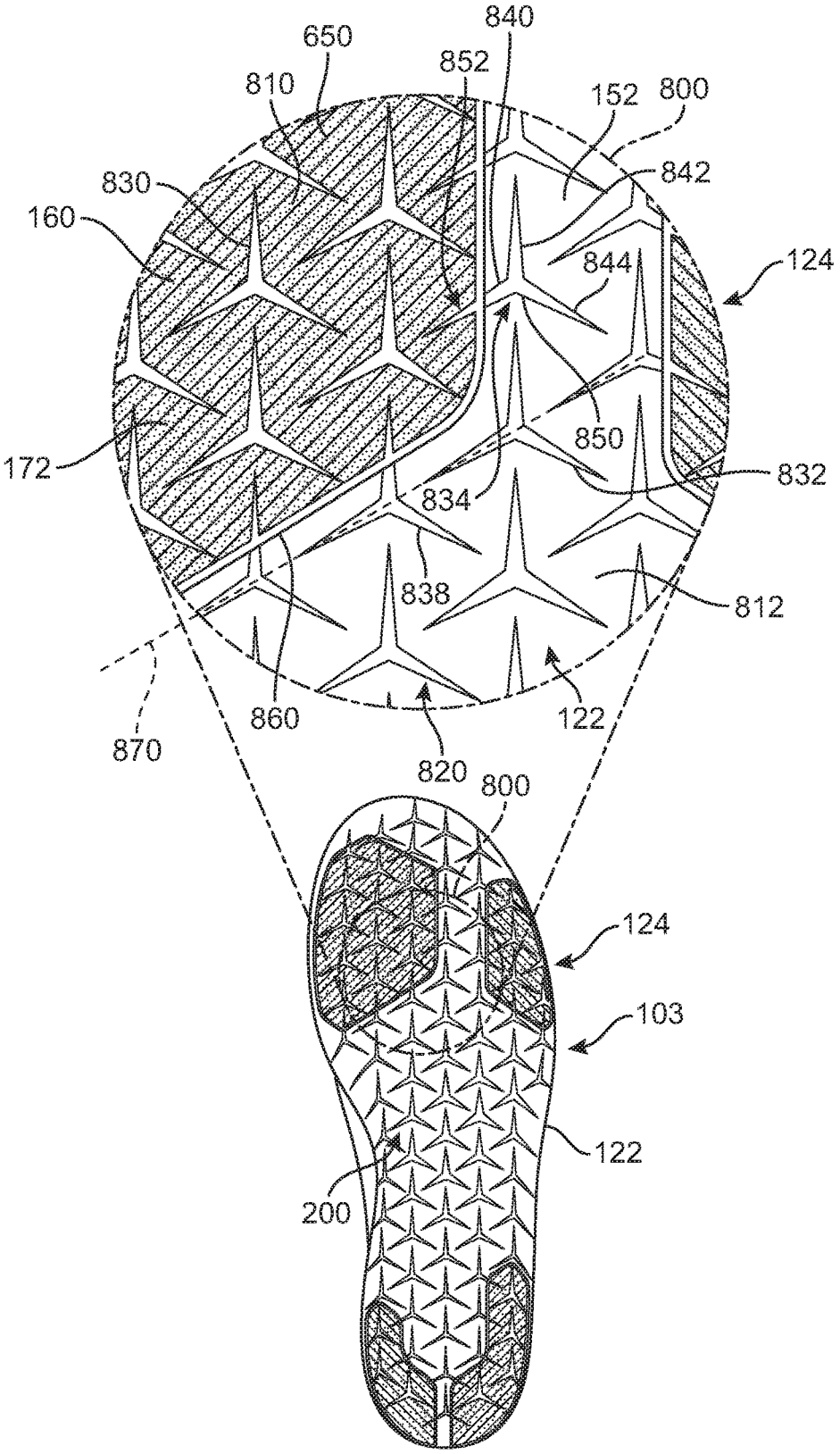
FIG. 8 is a bottom view of a sole structure including an enlarged view of a region extending through an outer sole member and a midsole component.
Figure 9:
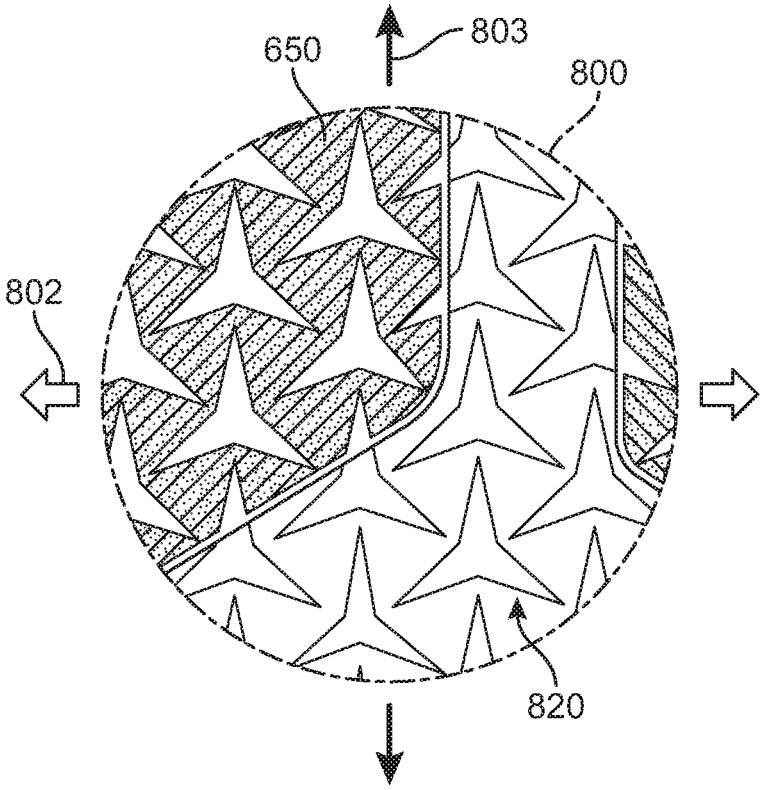
FIG. 9 is a schematic enlarged view of the region shown in FIG. 8.

FIGS. 8 and 9 illustrate a region 800 of sole structure 103 in an un-tensioned state (FIG. 8) and a tensioned state (FIG. 9). Thus, plurality of holes 200 are seen to open up (e.g., increase in opening or cross-sectional area) as sole structure 103 undergoes auxetic expansion due to tension 802. It is clear from FIG. 9 that region 800 expands both in the direction of tension 802 as well as in a direction 803, which is perpendicular to the direction of tension 802.

Embodiments may include provisions for ensuring the auxetic behavior of sole structure 103 is uniform, even across different portions or materials. In some embodiments, openings in one or more outer sole members may be aligned with openings in a midsole component.

Referring to FIG. 8, region 800 of sole structure 103 includes a first portion 810 and a second portion 812 of the outer surface of sole structure 103. Specifically, first portion 810 is a portion of outer surface 172 of first outer sole member 160, while second portion 812 is a portion of outer surface 152 of midsole component 122. Region 800 further comprises a set of holes 820 arranged in an auxetic configuration, which are a subset of plurality of holes 200.

As seen in FIG. 8, the auxetic configuration of set of holes 820 extends without interruption, or continuously, from first portion 810 of region 800 to second portion 812. In other words, the auxetic configuration of set of holes 820 extends without interruption between first outer sole member 160 and midsole component 122. As used herein, an auxetic configuration extends continuously or without interruption through a region if the pattern of holes (including the shapes, relative orientations of holes and spacing between holes) does not vary significantly throughout the region. Such an uninterrupted or continuous configuration is important because interruptions or breaks in the auxetic configuration or pattern of holes 820 could result in changes to, or deviations from, the desired auxetic motion or dynamics.

The continuation of the auxetic configuration or pattern between first portion 810 and second portion 812 is exemplified by considering several representative holes. As seen in FIG. 8, a first hole 830 of set of holes 820 is disposed in first portion 810 of first outer sole member 160. A second hole 832 of set of holes 820 is disposed in second portion 812 of midsole component 122. Both first hole 830 and second hole 832 are surrounded by six sole portions and by six adjacent holes. In addition, the orientations of first hole 830 and second hole 832, with respect to sole structure 103, are similar. Also, the pattern and spacing of the six adjacent holes around first hole 830 is similar to the pattern and spacing of six adjacent holes around second hole 832. Moreover, first hole 830 and second hole 832 have an approximately similar shape, specifically a tri-star shape.

The continuity of the auxetic configuration occurs even at the boundary between first portion 810 and second portion 812 (e.g., between first outer sole member 160 and midsole component 122). For example, a third hole 834 extends through both first portion 810 and second portion 812. Third hole 834 includes a first arm 840, a second arm 842 and a third arm 844. Further, third hold 834 is comprised of a first hole portion 850 that includes second arm 842 and third arm 844 as well as a part of first arm 840. Third hole 834 also includes a second hole portion 852 that includes the tip of first arm 840. As seen in FIG. 8, first hole portion 850 is disposed in second portion 812 and is continuous with second hole portion 852, which is disposed in first portion 810.

In at least some embodiments, the edges of an outer sole member could correspond with the auxetic configuration of holes. In particular, one or more edges of an outer sole member could be aligned with a direction defined by the orientations of two or more holes.

As seen in FIG. 8, for example, an edge 860 of first outer sole member 160 may be aligned with a direction defined by the orientation of plurality of holes 200. Specifically, plurality of holes may be arranged such that each hole includes an arm oriented in a direction characterized by first axis 870. For example, hole 832 and hole 838 both each have an arm oriented along first axis 870. Additionally, each of the holes in plurality of holes 200 has an arm oriented along or parallel to first axis 870. In the exemplary embodiment, edge 860 may be parallel with first axis 870. In a similar manner, in some embodiments, each edge of each outer sole member may be approximately aligned with a direction defined by the orientation of the holes (i.e., by the directions defined by each arm of the holes). In still some embodiments, some edges may be aligned with directions defined by the holes, while other edges may not be aligned with these directions. By aligning edges of each outer sole member with directions defined by the auxetic configuration, the outer sole members may be placed on sole structure 103 in a manner that does not interfere with the auxetic structure of the sole.

Figure 10:
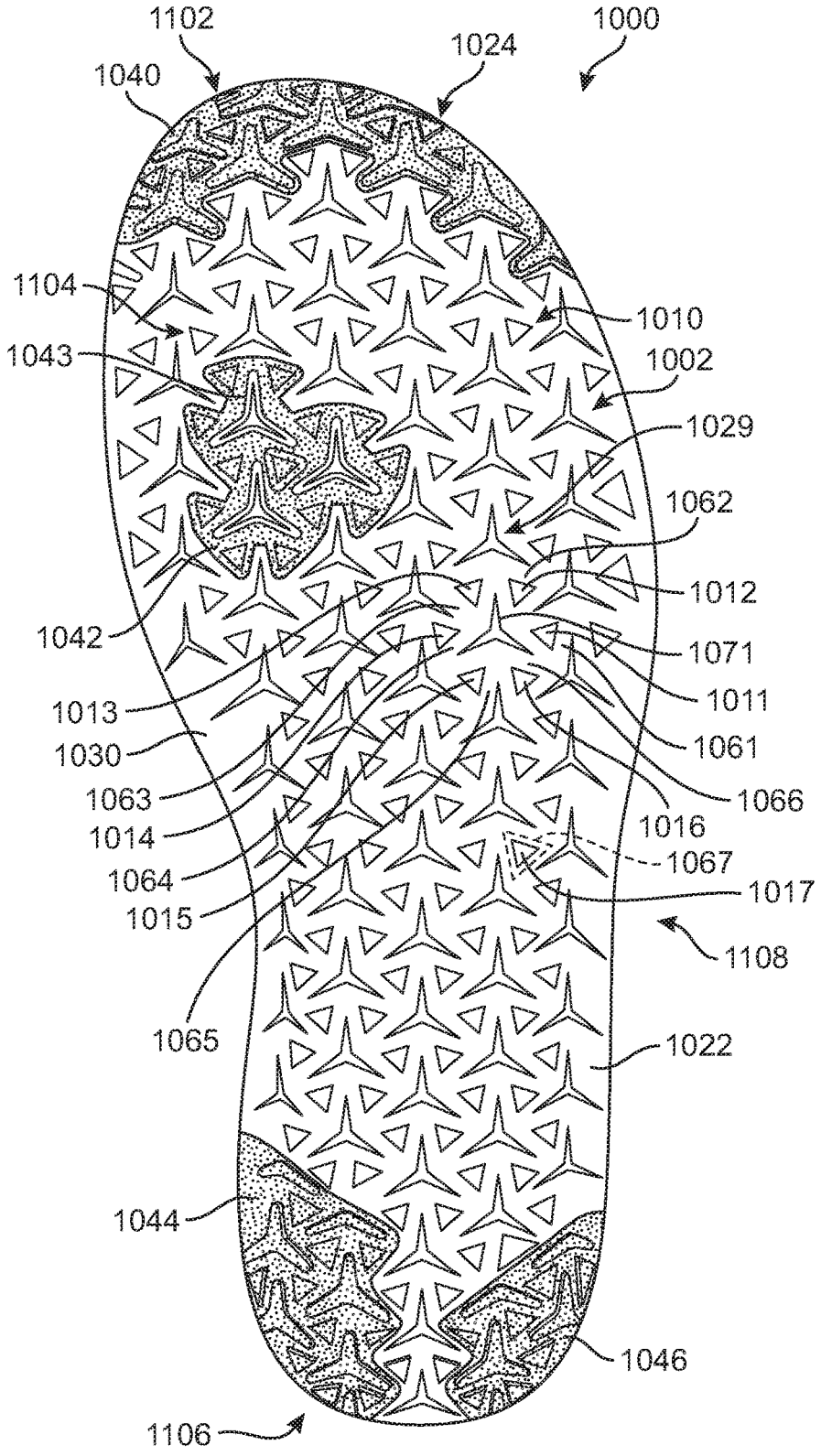
FIG. 10 is a bottom view of an embodiment of a sole structure with holes arranged in an auxetic configuration.

FIG. 10 illustrates a bottom view of another embodiment of a sole structure 1000. Referring to FIG. 10, sole structure 1000 may include an inner sole component (not visible), a midsole component 1022 and a plurality of outer sole members 1024. Each of these components could share similar provisions to corresponding components of the earlier embodiments, namely inner sole component 120, midsole component 122 and plurality of outer sole members 124.

Outer sole members 1024 may be configured in various locations on a lower portion 1030 of midsole component 1022. For example, the exemplary embodiment includes a first outer sole member 1040 disposed at front end portion 1102 of midsole component 1022. A second outer sole member 1042 is disposed within forefoot portion 1104 of midsole component 1022. In addition, a third outer sole member 1044 and a fourth outer sole member 1046 are disposed in heel portion 1106 of midsole component 1022. These exemplary locations may provide for an alternative traction profile, as compared to the embodiments shown in FIGS. 1-9. Specifically, the embodiment of FIG. 10 includes first outer sole member 1040 which provides enhanced traction over the entire forward edge of sole structure 1000, as well as third outer sole component 1044, which provides enhanced traction adjacent the ball of the foot.

It may be appreciated that the locations of one or more outer sole members could be varied in other embodiments. In some cases, the locations could be selected according to desired locations on the sole structure for enhancing traction. In other cases, the locations could be selected so as to avoid interference with auxetic expansion of the midsole component in certain regions portions, such as the midfoot portion 1108 of midsole component 1022.

In different embodiments, the shapes of outer sole members could vary. For example, the exemplary embodiment includes outer sole members that entirely cover midsole component 1022 (e.g., first outer sole member 1040, third outer sole member 1044 and fourth outer sole member 1046). Likewise, the exemplary embodiment includes outer sole members with apertures that expose portions of midsole component 1022 (e.g., second outer sole member 1042, which includes apertures 1043). Moreover, the exemplary embodiment depicts outer sole members that have patterns or arrangements generally corresponding with the pattern or arrangement of openings on midsole component 1022.

Midsole component 1022 is configured with a plurality of holes 1029 that are arranged in an auxetic configuration. In the exemplary embodiment of FIG. 10, plurality of holes 1029 may be similar in one or more respects to holes of the embodiments shown in FIGS. 1-9. In particular, some holes may be through holes, while other holes may be blind holes. Likewise, at least two different holes of plurality of holes 1029 could differ in opening size or cross-sectional area. As in previous embodiments, the arrangement of holes throughout midsole component 1022 may be selected to achieve desired auxetic properties for sole structure 1000.

Embodiments may include provisions for enhancing traction on a bottom or lower surface of a sole structure. In some embodiments, a sole structure may be provided with one or more tread elements. As used herein, the term "tread element" refers to a feature that extends outwardly on a ground engaging surface of a sole structure so as to engage the ground surface and provide increased traction.

As shown in FIG. 10, sole structure 1000 has a ground engaging surface 1002, which is comprised of the outermost surfaces of midsole component 1022 and of plurality of outer sole members 1024. Ground engaging surface 1002 may further include plurality of raised tread elements 1010.

Tread elements 1010 may be associated with sole portions of midsole component 1022. For example, a first tread element 1011 is approximately centered on first sole portion 1061. In an exemplary embodiment, the majority of sole portions may include an associated tread element. Moreover, the tread elements are arranged around each hole in a manner similar to the sole members. For example, a first hole 1071 is surrounded by first sole portion 1061, second sole portion 1062, third sole portion 1063, fourth sole portion 1064, fifth sole portion 1065 and sixth sole portion 1066. Each sole portion has a corresponding tread element, so that second tread element 1012, third tread element 1013, fourth tread element 1014, fifth tread element 1015 and sixth tread element 1016 are disposed on second sole portion 1062, third sole portion 1063, fourth sole portion 1064, fifth sole portion 1065 and sixth sole portion 1066, respectively. Thus, it may be understood that as each sole portion rotates under auxetic expansion the tread elements also rotate, thereby increasing frictional drag with a ground surface during the expansion.

In different embodiments, the geometry of a tread element could vary. Exemplary shapes include, but are not limited to: triangular geometries, rectangular geometries, polygonal geometries, circular geometries, rounded geometries, non-linear geometries, irregular geometries and/or any other kinds of geometries. In the exemplary embodiment of FIG. 10, tread elements 1010 have a triangular geometry that corresponds with the outer boundary geometry of the sole portions (e.g., the triangular boundary of a seventh sole portion 1067 matches a corresponding triangular geometry of seventh tread element 1017).

Each raised tread element of tread elements 1010 may be raised, or protrude from, the outer surface of sole structure 1000. Thus, each raised tread element may form a prism-like structure extending from sole structure 1000. While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. An article of footwear, comprising:

a sole structure having a longitudinal direction extending along a length of the article of footwear and a lateral direction extending along a width of the article of footwear;

the sole structure including a midsole component and at least one outer sole member;

the midsole component including a first outer surface with a recessed portion;

the outer sole member having a second outer surface;

wherein the recessed portion is configured to receive the outer sole member;

a region of the sole structure including a first portion in the first outer surface of the midsole component and a second portion in the second outer surface of the outer sole member;

the region including a plurality of holes arranged in an auxetic configuration;

wherein the auxetic configuration is configured such that when the region of the sole structure is under longitudinal tension it expands in both the longitudinal direction and the lateral direction and when the region of the sole structure is under lateral tension it expands in both the lateral direction and the longitudinal direction; and wherein at least one arm of a first hole of the plurality of holes is aligned with at least one arm of a second hole of the plurality of holes.

2. The article of footwear according to claim 1, wherein the at least one arm of the first hole and the at least one arm of the second hole are aligned along a first axis; and wherein another hole of the plurality of holes includes at least one arm that is aligned in a direction parallel to the first axis.

3. The article of footwear according to claim 1, wherein the outer sole member includes a plurality of edges defining a perimeter of the outer sole member.

4. The article of footwear according to claim 3, wherein at least one edge of the plurality of edges of the outer sole member aligned with a direction defined by the orientation of the at least one arm of the first hole and the at least one arm of the second hole.

5. The article of footwear according to claim 3, wherein the at least one arm of the first hole and the at least one arm of the second hole are aligned along a first axis; and wherein at least one edge of the plurality of edges of the outer sole member aligned in a direction parallel to the first axis.

6. The article of footwear according to claim 1, wherein the auxetic configuration includes a continuous pattern with uniform spacing between adjacent holes of the plurality of holes that extends through both the first portion and the second portion.

7. The article of footwear according to claim 1, wherein at least one hole of the plurality of holes extends through both the first portion and the second portion between the first outer surface of the midsole component and the second outer surface of the outer sole member.

8. The article of footwear according to claim 1, wherein the sole structure includes a plurality of separate outer sole members.

9. The article of footwear according to claim 8, wherein each outer sole member of the plurality of outer sole members includes at least one edge that is aligned with a direction defined by an orientation of arms of holes of the plurality of holes.

10. The article of footwear according to claim 8, wherein the plurality of outer sole members comprises four separate outer sole members.

11. The article of footwear according to claim 10, wherein the plurality of outer sole members comprises a first outer sole member, a second outer sole member, a third outer sole member, and a fourth outer sole member;

wherein the first outer sole member and the second outer sole member are disposed in a forefoot portion of the sole structure; and wherein the third outer sole member and the fourth outer sole member are disposed in a heel portion of the sole structure.

12. The article of footwear according to claim 1, wherein openings in the outer sole member are aligned with openings in the recessed portion of the midsole component.

13. The article of footwear according to claim 1, wherein the first outer surface of the midsole component is flush with the second outer surface of the outer sole member.

14. The article of footwear according to claim 1, wherein each hole of the plurality of holes has a tri-star geometry including three arms extending from a common center.

15. An article of footwear, comprising:

a sole structure having a longitudinal direction extending along a length of the article of footwear and a lateral direction extending along a width of the article of footwear;

the sole structure including a midsole component and at least one outer sole member;

the midsole component including a first outer surface with a recessed portion;

the outer sole member having a second outer surface;

wherein the recessed portion is configured to receive the outer sole member;

a region of the sole structure including a first portion in the first outer surface and a second portion in the second outer surface;

the region including a set of holes arranged in an auxetic configuration;

wherein the auxetic configuration is configured such that when the region of the sole structure is under longitudinal tension it expands in both the longitudinal direction and the lateral direction and when the region of the sole structure is under lateral tension it expands in both the lateral direction and the longitudinal direction;

wherein at least one hole of the set of holes is disposed in the first outer surface and wherein at least one hole of the set of holes is disposed in the second outer surface; and wherein the at least one hole disposed in the first outer surface includes an arm that is aligned with an arm of the at least one hole disposed in the second outer surface.

16. The article of footwear according to claim 15, further comprising at least one hole of the set of holes that extends through both the first portion and the second portion between the first outer surface of the midsole component and the second outer surface of the outer sole member.

17. The article of footwear according to claim 15, wherein the recessed portion of the midsole component has an outer recess edge; and wherein the outer sole member has an outer edge with a shape that is the same as a shape of the outer recess edge.

18. The article of footwear according to claim 15, wherein the auxetic configuration includes a plurality of holes of the set of holes that each have an arm oriented in a direction aligned along a first axis.

19. The article of footwear according to claim 18, wherein the outer sole member has an outer edge that is aligned with the first axis.

20. The article of footwear according to claim 19, wherein another edge of the outer sole member is aligned in a direction that is different from the first axis.

* * * * *